US005233327A

United States Patent [19]

Bartush et al.

[11] Patent Number: 5,233,327

[45] Date of Patent: Aug. 3, 1993

[54] ACTIVE RESISTOR TRIMMING BY DIFFERENTIAL ANNEALING

[75] Inventors: Thomas A. Bartush, Wappingers; James J. Curtin, Fishkill, both of N.Y.

[73] Assignee: International Business Machines Corporation, Armonk, N.Y.

[21] Appl. No.: 724,143

[22] Filed: Jul. 1, 1991

[51] Int. Cl.[5] ..... H01C 10/10

[52] U.S. Cl. ..... 338/195; 338/308; 338/309; 29/610.1; 156/643; 156/659.1

[58] Field of Search ..... 338/195, 308, 309, 314; 29/610.1; 156/DIG. 73, 379.6, 272.2, 643, 659.1

[56] References Cited

U.S. PATENT DOCUMENTS 4,392,992 7/1983 Paulson et al. ..... 338/309

4,703,557 11/1987 Nespor et al. ..... 338/308

*Primary Examiner*—Marvin M. Lateef

*Attorney, Agent, or Firm*—Whitham & Marhoefer

[57] ABSTRACT

A process of fabricating an electrical resistor and a product produced thereby in which trimming of a resistive element of a material exhibiting thermosetting properties is accomplished by in-situ annealing of one or more regions across the width of the resistive element to certain predetermined temperatures, thereby altering the crystal properties and the sheet resistance within those regions. Annealing is preferably done by laser radiation at levels below that at which any cutting or ablation of the resistive element will occur, thus avoiding defects in the resistor or associated circuits. By controlling laser radiation and the annealing process, virtually any desired trim slope may be obtained, resulting in improved trimming accuracy. Efficiency of the process is enhanced by annealing the resistive element to obtain compound trim slopes corresponding to coarse and fine trimming of the resistive element.

18 Claims, 2 Drawing Sheets

ACTIVE RESISTOR TRIMMING BY DIFFERENTIAL ANNEALING

BACKGROUND OF THE INVENTION

1. Field of the Invention

This invention generally relates to the formation of electronic resistors and, more particularly, to the adjustment of resistance accuracy of resistors formed for use with integrated circuits.

2. Description of the Prior Art

Resistors are a very basic element of many electrical and electronic circuits. All materials exhibit a characteristic resistance to the flow of electricity therethrough, which is referred to as the bulk resistance of the material. Exploiting this property of some materials having a moderate bulk resistance value, electrical resistors usually consist of a volume of material having a predetermined cross-sectional area and a predetermined length with respect to the locations on that volume of material where electrodes are applied. Length can be generally taken to be the distance between the terminals and the cross-sectional area can generally be measured in a plane perpendicular to the length. The actual value of elctrical resistance for a resistor formed of a given material will vary proportionally with length and inversely with cross-sectional area.

In the manufacture of resistors, the precision of the dimensions of the resistive element will affect the accuracy of the resistance value as compared with the intended design value. Therefore resistors are commonly available having different resistance tolerances, 10%, 5% and 1% being typical. Higher accuracy is typically achieved by a process known as trimming, which, as the name implies, generally involves cutting away of a portion of the cross-section of the resistive element to increase the resistance to an exactly desired value.

With the development of complex integrated circuits, it has become common to fabricate one or more resistors, including networks and arrays of transistors on a single substrate, often in combination with active integrated circuit elements such as transistors. A digital-to-analog converter circuit is an example of a circuit which may include a resistance array as well as digital logic elements and analog amplifier and feedback circuits on a single chip. However, many digital logic circuits will also typically contain at least a few resistors, often for the purpose of adjusting switching threshold voltages or output levels (e.g. pull-up or pull-down resistors.

For such miniaturized applications, resistive elements are often formed of thin layers of metal, doped silicon or metal oxides of predetermined widths on the substrate or within the structure of the semiconductor device. In such constructions, it is common to refer to the sheet resistance of the material. Trimming is often even more literally done by trimming away a portion of the width of the material layer. This has commonly been done by etching but, as devices have become smaller, lasers have been employed to vaporize or ablate small areas of the deposited resistive material. However, in extremely small devices and in highly sophisticated integrated circuits, such intense local applications of heat have often not yielded sufficiently accurate adjustment of the resistance of a resistor formed therein. Such intense heat has also led to other problems, occasionally destructive of the integrated circuit device itself.

Specifically, when the resistive element is cut by the laser, some of the material may melt without being vaporized and bridge the kerf in the resistor which is cut by the laser. This causes a smaller than intended change in the resistor value. The kerf width may also vary somewhat unpredictably because of underlying device topology which alters the degree of heating caused by a predetermined amount of laser power applied. Further, surface contamination can interfere with the actual application of heat to the material with a laser, either by reflecting energy or causing it to be absorbed in greater than the expected degree. Similarly, depending on the wavelength of the laser radiation, there may be constructive or destructive interference in the vicinity of the resistive element due to variations in underlying quartz layer thicknesses. It must be recognized that irregularities in the laser kerf can cause current crowding which will result in "hot spots" in the resulting resistor, when operated. This "hot spots" effect will result in a reduction of the reliability of the resistor (since it will then resemble a fuse) and possibly aggravate temperature dependent resistance change.

Also, such localized heating may cause delamination of the resistor or other integrated circuit layers from underlying layers or micro cracking of the substrate or layers of the integrated circuit. Such structural defects in the integrated circuit may cause circuit discontinuities, localized power dissipation problems leading to premature failure of the device and other effects adversely impacting the functionality, reliability and operating margins of the integrated circuit.

SUMMARY OF THE INVENTION

It is therefore an object of the present invention to provide a technique of laser trimming of resistive elements with a laser at reduced temperatures.

It is another object of the invention to provide a technique of laser trimming of resistive elements of increased dimensional tolerance and which is productive of results of improved uniformity.

It is a further object of the invention to provide a technique of laser trimming of resistive elements productive of improved accuracy of resistance value.

In order to accomplish the above and other object of the invention, there is provided a process for forming an electrical resistor comprising the steps of forming a film of a material exhibiting thermosetting electrical properties on a substrate, and in-situ annealing at least one region extending across the width of the film.

In accordance with another aspect of the invention, an electrical resistor is provided, formed by a process including a step of trimming a resistive element having thermosetting electrical properties, including the step of annealing at least one region extending across a width of the resistive element.

In accordance with a further aspect of the invention, an electrical resistor is provided including a resistive element exhibiting thermosetting electrical properties and wherein at least one region of said resistive element is differentially annealed with respect to another region thereof.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
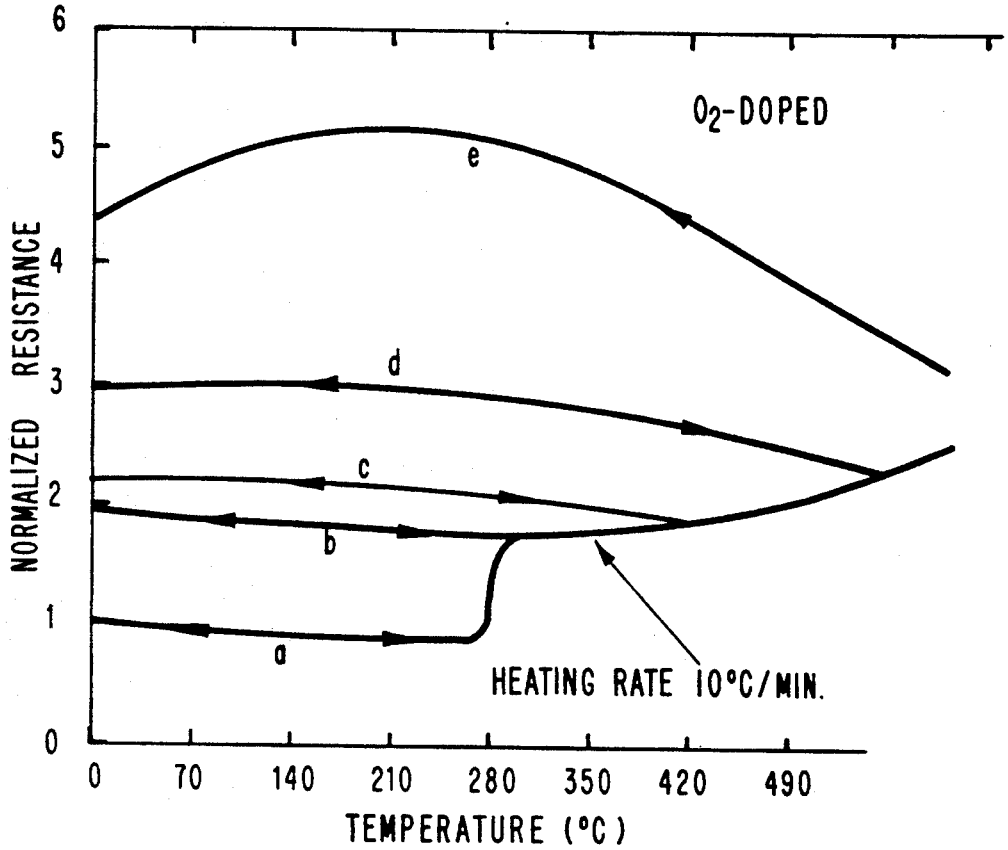
FIG. 1 is a graph of normalized sheet resistance as a function of temperature and showing a plurality of reversible heating/cooling curves for a thin film of Cr-Si, oxygen doped thin film.

Referring now to the drawings, and more particularly to FIG. 1, there is shown a graphical diagram of Cr-Si, oxygen doped, thin film normalized resistance as a function of temperature when heated at a rate of 10° C. per minute. More specifically, these curves represent observed thin film normalized resistance values for a 72% silicon, 28% chromium alloy which has been doped with oxygen, typically during ion implantation or ion beam deposition. This material has been in use for some years as a thin film resistor material and its suitability for such a purpose is well-established. The generally horizontal lines a–e with double arrows are reversible heating/cooling curves and, thus represent subtle but stable alterations in the crystal structure in thin films of this material. The curves depicted in FIG. 1 are for the material having the above-recited proportions of silicon and chromium and will be approximately correct for compositions differing from the noted proportions by as much as ten percent. However, it should be recognized that other curves depicting similar characteristics of some other compositions and, especially, other proportions of a silicon and chromium composition will exist. For instance, for a composition of 60% chromium and 40% silicon, the curve a of FIG. 1 would curve generally downwardly over its length (i.e. resistance decreases with annealing) and stable, reversible curves b–e would lie below curve a. Therefore, although the invention will be described with reference to a composition which has the behavior depicted in FIG. 1, the invention is clearly applicable to other materials in light of this description of the properties of materials with which the invention is preferably practiced.

It should also be noted in regard to FIG. 1 that the exact shapes of the high temperature portions of curves a and e of FIG. 1 have not been precisely determined, although it is clear that both curves converge at some point. There is some evidence to suggest that both of these curves exhibit a negative slope at higher temperatures and that curves b–d intersect curve a at at least two points. This appears to allow trimming to involve both increases and decreases in resistance in the course of the trimming process for some application but it is of less practical importance to the manufacture of integrated circuits due to the higher temperatures involved.

It has been recognized that the bulk or sheet resistance of a material is a function of both the composition itself (e.g. the number of conduction band electrons in the atoms of the material) and, generally, to a far lesser degree, the crystal structure of the material. It has been speculated that changes in crystal structure of the material of electronic components is a factor in the so-called aging or deterioration of such components. The so-called "burning-in" of newly fabricated components may also be due to thermally induced changes in the crystal structure to a more stable configuration. However, such thermal phenomena have not been exploited. Under virtually all circumstances, such "burning-in" is used to bring the materials of the electrical components to a stable condition where further change in electrical characteristics will be minimal throughout the useful lifetime of the components.

This is also true for the Si-Cr, oxygen doped, material referred to above, where, during normal resistor fabrication, a final annealing temperature of 400° C. is used to establish the sheet resistance of the resistive element formed. Thereafter, laser cutting of the resistive element has been done to tailor the resistive element to the specific value of resistance desired. This tailoring process can correct for processing variations in the resistor value of approximately ±15%.

However, it has been discovered that the above Si-Cr, oxygen doped, material is a thermosetting material. That is, the sheet resistance value depends on the highest annealing temperature to which the material is subjected and which will thereafter remain stable and repeatable at lower temperatures. Thus, in the prior practice, annealing to a temperature in the range where the annealing curve is relatively horizontal (e.g. in the vicinity of the right-hand end of curve c of FIG. 1) will yield an accurately determinable sheet resistance even for a substantial possible variation in the annealing temperature or time. However, the inventors have discovered that a plurality of stable, repeatable resistance curves exist for this and some other materials and the alteration of crystal structure during annealing has been observed.

Figure 2:
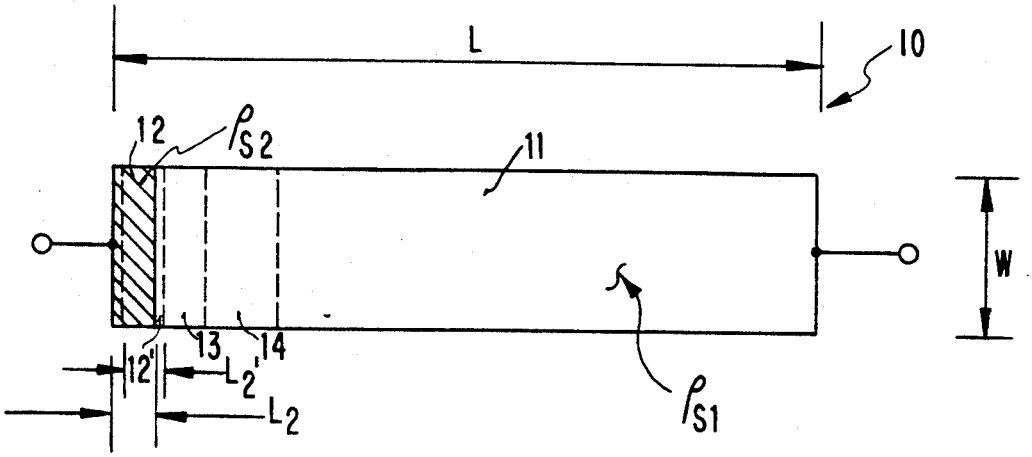
FIG. 2 is a schematic diagram of a resistance trimmed in accordance with the present invention.

Referring now to FIG. 2, a thin film resistor in accordance with the present invention is illustrated. As initially formed, the resistive element will have a sheet resistance of $\rho_{s1}$ throughout its width W and length L, determined by annealing to 400° C. If a laser beam of suitably low power is passed over region 12 but not region 11, at a suitable speed, region 12 will be selectively heated to a higher temperature (e.g. 500° C., or higher) thus selectively altering the bulk or sheet resistance in region 12 while leaving the bulk or sheet resistance of region 11 unchanged. This differential annealing results in the division of a single resistance of length L and sheet resistance $\rho_{s1}$ into two series resistances: one of length $L-L_2$ and sheet resistance $\rho_{s1}$ and the other of length L2 and sheet resistance $\rho_{s2}$. The sheet resistance of region 11 is altered by the selective in-situ annealing process to follow reversible temperature/normalized resistance curve d rather than curve c of FIG. 1.

More specifically, the in-situ annealing process is conducted at a laser power of between 0.2 to 0.3 milliwatts over a 5 micron spot corresponding to a power density of about 10–15 watts per square millimeter) which is sufficient to cause rapid heating of the area where the laser beam impinges on the target (e.g. the resistive element) and 0.5 milliwatts, at which power level the laser begins to cut the resistive element. The width of $L_2$ will correspond to the laser beam diameter and a dimension of 5 to 6 μm can be readily obtained within the present laser technology. However, it is contemplated that narrower beam widths may yield somewhat improved accuracy in some circumstances and it is to be understood that the invention does not rely on the laser beam width being within the noted range.

In fact, the resolution of the trimming process is limited only by the positioning accuracy of the laser beam. For instance, if it were desired to slightly increase the resistance beyond the change caused by a single pass of the laser across the resistive element, it would be possible to make the across the region indicated by $L_2'$ in FIG. 2 The material in the region common to both $L_2$ and $L_2'$ would not be further annealed since the highest temperature achieved would not be higher than that reached during the in-situ annealing of region $L_2$. Thus the increment of resistance would correspond only to the differential due to the increased length of region 12' and the decrease of the length of region 11 by the same amount. The only limitation of the process of the invention imposed by the minimum laser beam diameter available is the minimum incremental change which can be caused. This limitation is of no practical significance since the value of the resistor before trimming can be reduced below the desired value by any arbitrary amount to assure that at least a minimum change due to trimming by in situ annealing will be required.

It should also be noted in regard to the minimum dimension of $L_2$ that the effective sheet resistance need not be limited to a single resistance corresponding to one of the curves of FIG. 1 but that alteration of the energy applied to the annealed region 12 may also be suitably controlled so that the average sheet resistivity effectively may fall between the curves. For example, if the annealing time is reduced, annealing will be less than complete throughout the volume of region 12 and it will usually be fairly homogeneous. The resistive element will normally be very thin (about 500 Angstroms) and therefore the element will be only a single grain thick. During annealling, the grain size will gradually increase, altering conduction properties of portions of the resistive element. Therefore, (assuming, say, the desired conversion is from curve c to curve d) if the annealing time is shortened to provide annealing of only, say, half the volume of region 12, the resulting sheet resistance would be appropriately interpolated between these curves. Therefore, by appropriate control of laser energy and annealing time, any desired sheet resistance between curves a and e may be obtained within region 12. This resistance will be stable because individual portions of the volume of the annealed region 12 will exhibit the conduction properties described by the reversible lines b–e of FIG. 1. It is for this reason also that the minimum length of the in-situ annealed reason is not, in fact, a practical limitation on the accuracy of the trimming technique in accordance with the invention.

Thus, in summary, to reach a desired value during trimming by the in-situ annealing process according to the invention, it is only necessary to make one or more low power laser passes across the resistive element to extend the length of the $L_2$ region as shown by dotted lines defining regions 13, 14, until the desired resistance is reached. If some time or apparatus is provided for cooling between passes, overlap of the laser passes does not cause further annealing of the material in the region undergoing multiple passes of the laser. The total resistance of the trimmed resistor will be given by the expression $$R_t = \rho_{s2}\frac{L_2}{W} + \rho_{s1}\frac{L_1}{W}$$

where $\rho_{s1}$ = sheet resistance of the bulk material,
$\rho_{s2}$ = sheet resistance of the annealed strip,
W = the width of the resistive element,
$L_1$ = the length of the bulk resistor ($L - L_2$), and
$L_2$ = the length of the annealed strip.

Alternatively, this can be expressed as $$R_t = \frac{\rho_{s1}L + L_2(\rho_{s2} - \rho_{s1})}{W}$$

and by picking appropriate approximate values for reversible curves a–e (but preferably only a–d) of FIG. 1 (or values interpolated therebetween, as described above) and substitution, the necessary trimming length $L_2$ can be directly obtained and used for guidance of the annealing laser beam.

As indicated above, it is desirable, according to the invention to anneal the resistive element to a temperature well above the design operating temperature of the chip on which the resistor is located in order to avoid alteration of the resistance during operation. However, it is seen from FIG. 1, that even curve a is substantially horizontal to a temperature of about 280° C. and annealing of the entire resistive element may not be necessary or even desirable in some applications. On the other hand, as is evident from FIG. 1, the highest trimming accuracy will be produced if the resistive element is first annealed to a temperature of about 320° C. and in-situ laser annealing carried out to a temperature of 420° C. (conversion from curve b to curve c, which are most closely spaced). For most applications, however, annealing to 400° C. of the resistive element for generally unconditional stability with in-situ annealing to about 540° C. (conversion from curve c to curve d) will be preferable. However, it is to be understood that the invention is not to be considered as limited to annealing to only a single temperature, although for simplifying the process, such processing may be preferred in a majority of applications.

It should be appreciated that the process of in-situ annealing of selected portions of the resistive element avoids all of the above-noted defects which may be caused by laser cutting of the resistive element because of the lower temperatures involved. In addition, the in-situ annealing process is far more accurate for a given degree of precision in laser beam positioning since the differential resistivity between the bulk material and the in-situ annealed material is smaller than the differential between the bulk material and the infinite resistivity of removed material. Further, since the in-situ annealing process is performed generally perpendicular to the length of the resistive element and across the full width thereof, there is a much reduced possibility of causing current concentrations in portions of the resistive element which might lead to undesirably high current densities and premature element failure.

Figure 3:
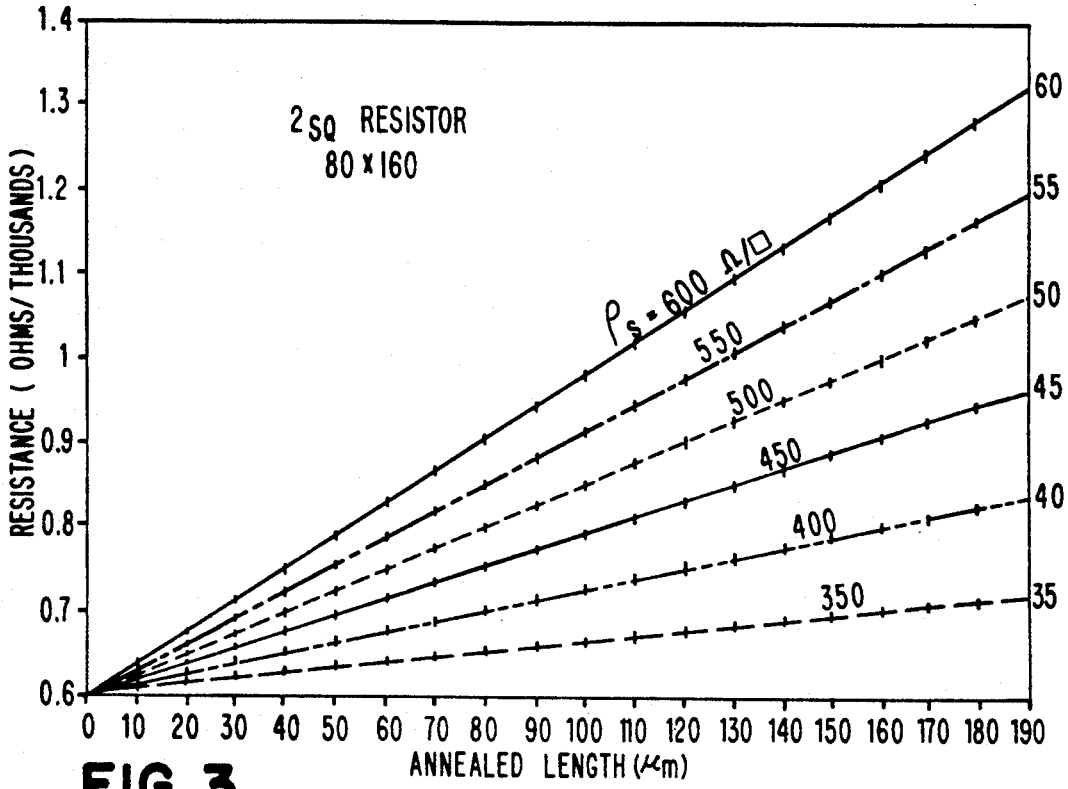
FIG. 3 is a graph illustrating the resistance of the resistor of FIG. 1 as a function of annealed length.

Referring now to FIG. 3, a family of lines is shown giving the total resistor value $R_t$ for a given resistive element length and width as a function of the in-situ annealed length thereof. It should be noted from FIG. 3 that the specific sheet resistances shown do not specifically correspond to any one of curves a–e of FIG. 1 and that any desired effective resistance can be obtained. It is assumed, however, that the sheet resistance of the bulk of the resistive element is approximately 300 ohms per square. Thus, if an arbitrary length of the bulk resistive element were to be annealed to one of the sheet resistances shown, the resistance of the entire resistor is determinable based on the annealed length and the annealed sheet resistance. It is apparent that the relationship is linear and the result of the process is therefore highly predictable. Each of the lines shown in FIG. 3 has a specific slope, referred to as the trim slope. It is important to note, for a full appreciation of the invention that the trim slope is generally very shallow and the variation between annealing temperatures represented by the lines depicted spans over 200° C., indicating substantial tolerance and very high potential accuracy in the process according to the invention. It should also be noted that the process according to the invention can potentially provide correction of the trimming process by annealing to a higher temperature where curve a of FIG. 1 may assume a negative slope. Further, since the electrical resistance of the resistive element exhibiting thermosetting electrical properties depends upon grain or crystal structure, it is possible to correct the trimming process by ion implantation of oxygen, silicon or metals to slightly disturb the crystal or grain structure. However, since one of the benefits of the invention is that resistor trimming can be done after the chip is complete and coated with a protective layer, trimming or correction of trimming by such ion implantation is difficult to achieve with high accuracy unless the protective coating is removed.

Figure 4:
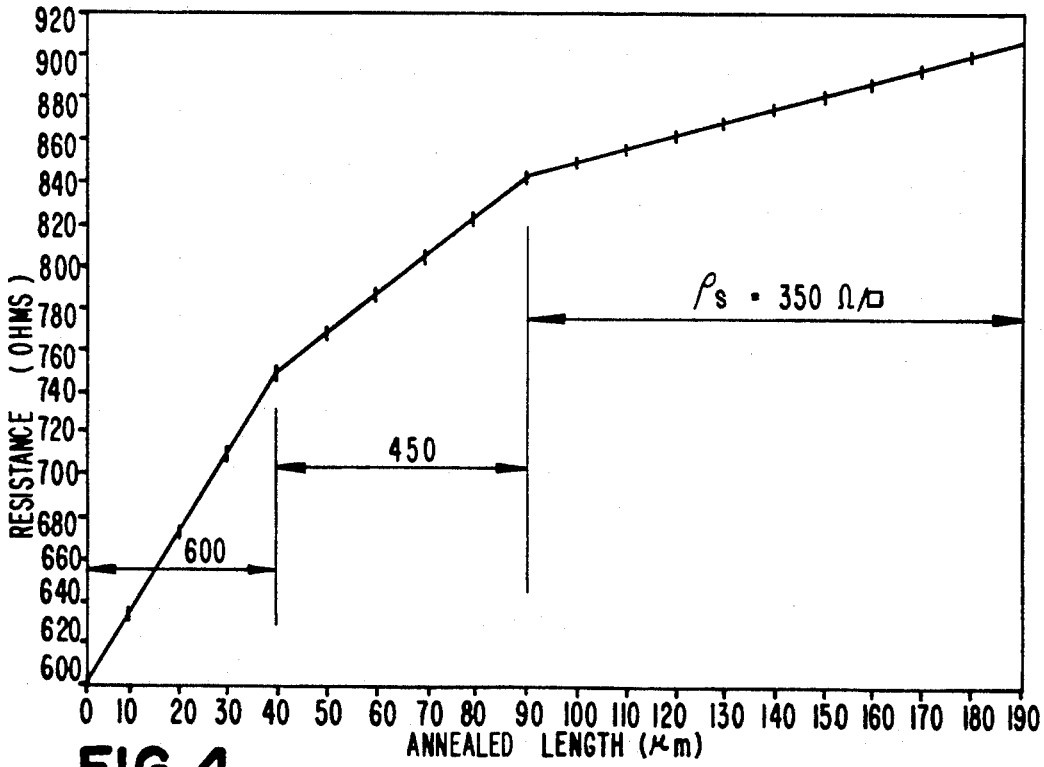
FIG. 4 illustrates a compound trim slope exemplary of a variation of the invention.

Referring now to FIG. 4, in this regard, it is seen that the invention can provide varying degrees of coarse and fine trimming of the resistor. The graph of FIG. 4 is similar to that of FIG. 3 but the vertical axis is, comparatively, greatly expanded. In this case, where an increase of resistance of 300 ohms is desired, a length of 40 μm of the resistive element is annealed at a relatively high temperature (e.g. conversion to curve d of FIG. 1) to achieve about one-half of the desired correction. This is desirable to obtain the highest degree of stability of a major portion of the annealed region (e.g. region 12 of FIG. 2). Thereafter, about two-thirds of the remaining correction is made by annealing to a lower temperature (e.g. conversion to curve c of FIG. 1) but carrying out the annealing fully throughout the bulk of an additional region (e.g. region 13 of FIG. 2). This also assures a high degree of stability of the completed resistor. Finally, a third region (e.g. region 14 of FIG. 2) is annealed under limited time or laser power constraints to complete the correction and to approach the desired resistor value along the shallowest possible trim slope to obtained the highest degree of trimming accuracy. It is also to be noted that this final process is carried out over substantially the entire remainder of the resistor length to minimize the possibility of overlap of passes of the annealing laser radiation. It should be noted in this regard, that when time or laser radiation is controlled such that annealing is not complete throughout the bulk of the material at a given annealing temperature, overlap of laser passes will cause additional annealing and may cause non-linearities in the partial annealing step of the process. Therefore, it is desirable to minimize overlap as much as possible by conducting partial annealing over a large portion of the remainder to the bulk resistive element and not necessarily limiting the third step of the above process to region 14 of FIG. 2.

In view of the foregoing, it is seen that the process of laser trimming of resistive elements by in-situ annealing avoids the production of defects observed in the prior art by allowing trimming at lower temperatures. The process of the invention also provides a higher degree of accuracy and is more consistent with desirable resistor geometries than prior trimming processes involving cutting or ablating of the resistive element and is virtually independent of all other processes and materials which may be involved in the production of any integrated circuit with which a resistor formed in accordance with the present invention may be used.

While the invention has been described in terms of a single preferred embodiment, those skilled in the art will recognize that the invention can be practiced with modification within the spirit and scope of the appended claims. For instance, while the invention has been explained with reference to Si-Cr, oxygen doped, materials, it would be equally applicable to any other material exhibiting thermosetting electrical properties as described above.

Having thus described our invention, what we claim as new and desire to secure by Letters Patent is as follows:

1. A process for forming an electrical resistor comprising the steps of forming a film of a material exhibiting thermosetting electrical properties, wherein sheet resistance of a region is determined by the highest temperature to which the region is subjected, on a substrate, said film having a length and a width, and in-situ annealing at least one region extending across said width of said film to a temperature determined in accordance with a desired sheet resistance.

2. A process as recited in claim 1, wherein said forming step includes a step of annealing said film.

3. A process as recited in claim 3, further including another step of in-situ annealing a further region extending across said width of said film.

4. A process as recited in claim 3, wherein said further region partially overlaps said at least one region of said film.

5. A process of trimming a resistive element formed of a material having thermosetting electrical properties, wherein sheet resistance of a region is determined by the highest temperature to which the region is subjected, including the steps of annealing said resistive element, and differentially annealing at least one region extending across a width of said resistive element to a temperature determined in accordance with a desired sheet resistance.

6. A process as recited in claim 5, wherein said annealing step is carried out to reach a predetermined temperature throughout at least one region across said width of said film.

7. A process as recited in claim 6, further including another step of in-situ annealing a further region extending across said width of said resistive element.

8. A process as recited in claim 7, wherein said further region partially overlaps said at least one region of said resistive element.

9. An electrical resistor formed by a process including a step of trimming a resistive element, said resistive element being formed of a material having thermosetting electrical properties, wherein sheet resistance of a region is determined by the highest temperature to which the region is subjected, wherein said trimming step includes the steps of annealing said resistive element, and differentially annealing at least one region extending across a width of said resistive element to a temperature determined in accordance with a desired sheet resistance.

10. An electrical resistor as recited in claim 9, wherein said annealing step is carried out to reach a predetermined temperature throughout at least one region across said width of said film.

11. An electrical resistor as recited in claim 10, wherein said trimming step further includes another step of in-situ annealing a further region extending across said width of said resistive element.

12. An electrical resistor as recited in claim 11, wherein said further region partially overlaps said at least one region of said resistive element.

13. An electrical resistor as recited in claim 9, wherein said material having thermosetting electrical properties comprises approximately 72% silicon and 28% chromium.

14. An electrical resistor as recited in claim 13, wherein said material further includes an oxygen dopant.

15. An electrical resistor including a resistive element formed of a material exhibiting electrical properties which are determined by at least one of time and temperature of annealing, at least one region of said resistive element being differentially annealed with respect to another region thereof.

16. An electrical resistor as recited in claim 15, wherein said material consists essentially of silicon and chromium.

17. An electrical resistor as recited in claim 16, wherein said material includes approximately 72% silicon and 28% chromium.

18. An electrical resistor as recited in claim 17, wherein said material further includes oxygen.

* * * * *